US007999691B2

(12) United States Patent
Wolf et al.

(10) Patent No.: US 7,999,691 B2
(45) Date of Patent: Aug. 16, 2011

(54) METHOD AND APPARATUS FOR MONITORING BARRIER INTERCONNECTIONS

(76) Inventors: Wayne Alan Wolf, Kelowna (CA); Roger David Scott Goldammer, Kelowna (CA)

( * ) Notice: Subject to any disclaimer, the term of this patent is extended or adjusted under 35 U.S.C. 154(b) by 307 days.

(21) Appl. No.: 12/268,116

(22) Filed: Nov. 10, 2008

(65) Prior Publication Data

US 2010/0117847 A1 May 13, 2010

(51) Int. Cl.
*G08B 21/00* (2006.01)

(52) U.S. Cl. ..... 340/686.6; 340/686.1; 340/545.7

(58) Field of Classification Search ..... 340/686.1, 340/686.2, 686.4, 686.5, 686.6, 545.8, 545.9, 340/551, 545.7; 194/205; 180/286; 324/207.26; 105/341

See application file for complete search history.

(56) References Cited

U.S. PATENT DOCUMENTS

| | | | | |
|---|---|---|---|---|
| 3,415,013 | A | 12/1968 | Galbraith | |
| 4,249,446 | A | 2/1981 | Tallerico, Jr. | |
| 4,281,473 | A | 8/1981 | Emalfarb et al. | |
| 4,519,729 | A | 5/1985 | Clarke, Jr. et al. | |
| 4,601,615 | A | 7/1986 | Cavalli | |
| 4,607,981 | A | 8/1986 | van Klinken | |
| 4,664,560 | A | 5/1987 | Cortlever | |
| 4,671,705 | A | 6/1987 | Nussbaumer et al. | |
| 4,674,921 | A | 6/1987 | Berger | |
| 4,771,240 | A * | 9/1988 | Meyer et al. | 324/252 |
| 4,808,039 | A | 2/1989 | Fischer | |
| 4,953,689 | A | 9/1990 | Peterson et al. | |
| 5,054,961 | A | 10/1991 | Sherman | |
| 5,070,642 | A | 12/1991 | Albrecht | |
| 5,106,233 | A | 4/1992 | Breaux | |
| 5,119,739 | A * | 6/1992 | Templeton et al. | 105/341 |
| 5,145,287 | A | 9/1992 | Hooper et al. | |
| 5,163,785 | A | 11/1992 | Zanelli et al. | |
| 5,274,969 | A | 1/1994 | Kazakidis | |
| 5,291,708 | A | 3/1994 | Johnson | |
| 5,292,208 | A | 3/1994 | Berger | |
| D352,871 | S | 11/1994 | Miller et al. | |
| 5,360,293 | A | 11/1994 | Breaux et al. | |
| 5,388,931 | A | 2/1995 | Carlson | |
| 5,497,097 | A | 3/1996 | Walling et al. | |
| 5,520,487 | A | 5/1996 | Decker | |
| 5,528,857 | A | 6/1996 | Ashleigh et al. | |
| D381,098 | S | 7/1997 | Gay | |
| D382,656 | S | 8/1997 | Yemini | |
| 5,758,993 | A | 6/1998 | Schmednecht et al. | |

(Continued)

FOREIGN PATENT DOCUMENTS

CA 1245061 11/1988

*Primary Examiner* — Van T. Trieu

(74) *Attorney, Agent, or Firm* — Dwayne E. Rogge; Hughes Law Firm, PLLC

(57) ABSTRACT

Revealed herein is a system and method for monitoring continuity between adjacent barrier members. Each barrier member has a first edge defining a first connector and an opposed second edge defining a second connector. The second connector is adapted to cooperatingly engage a corresponding first connector of an adjacent barrier member. The system comprises detectable bodies along the first connector of the barrier member and a detector locatable along the second connector of the adjacent barrier member. The detector detects the proximity of the detectable bodies. The method comprises inserting a first barrier member into a soil formation, engaging the second connector of a second barrier member with the first connector and inserting the second barrier member into the soil formation adjacent to the first barrier member while utilizing the detector to verify engagement of the first and second connectors.

22 Claims, 10 Drawing Sheets

U.S. PATENT DOCUMENTS

| | | | | |
|---|---|---|---|---|
| 5,782,583 | A | 7/1998 | Vales | |
| 5,881,508 | A | 3/1999 | Irvine et al. | |
| 5,911,546 | A | 6/1999 | Vales | |
| 5,957,625 | A | 9/1999 | Vales | |
| D416,096 | S | 11/1999 | Tisbo et al. | |
| 6,000,883 | A | 12/1999 | Irvine et al. | |
| D420,154 | S | 2/2000 | Irvine et al. | |
| 6,033,155 | A | 3/2000 | Irvine et al. | |
| 6,053,666 | A | 4/2000 | Irvine et al. | |
| 6,575,667 | B1 | 6/2003 | Burt et al. | |
| 6,834,740 | B2 * | 12/2004 | Kurttila | 180/286 |
| 7,025,539 | B2 | 4/2006 | Irvine | |
| 7,056,066 | B2 | 6/2006 | Irvine | |
| 7,059,807 | B2 | 6/2006 | Irvine | |
| 7,172,371 | B2 | 2/2007 | Nickelson et al. | |
| 7,393,482 | B2 | 7/2008 | Irvine | |
| 2009/0051356 | A1 * | 2/2009 | Nishide | 324/207.26 |
| 2009/0266673 | A1 * | 10/2009 | Dallaire et al. | 194/205 |

* cited by examiner

METHOD AND APPARATUS FOR MONITORING BARRIER INTERCONNECTIONS

BACKGROUND OF THE DISCLOSURE

1. Field of the Disclosure

The present disclosure relates to barrier walls in general and in particular to a method and apparatus for monitoring the below surface connection of adjacent barrier members forming a subterranean barrier.

2. Description of Related Art

In the field of geotechnical engineering, it is frequently necessary to physically isolate one area in a soil formation from an adjacent area for a variety of purposes. These purposes may include providing either a temporary or a permanent retaining wall, or may be for the purpose of isolating contaminants in one of those areas of soil from the other. One known method of providing such isolation is to insert successive panels into the soil formation between the two areas so as to form a continuous barrier therebetween. In the case of remediation work where the purpose is to contain and remove contaminants from the soil of one of the areas, it is frequently necessary to ensure that the barrier created by such panels does not have significant gaps therebetween which may allow the contaminants to escape.

One common method of inserting such panels into the ground is to vertically orient the panel above the surface of the soil formation and apply sufficient pressure to the top of the panel so as to forcibly insert the panel into the soil formation. Successive panels may be thereafter similarly inserted into the soil formation with a slidable interconnection between the two adjacent panels to assure continuity.

A difficulty with present methods of inserting remediation panels into soil formations is their susceptibility to encountering large boulders or other subsurface objects. It is well known that encountering such subsurface objects may cause the panel to buckle or otherwise deform. Buckling of one remediation panel may cause the connector of that panel to disengage or unzipper from the corresponding connector of an adjacent panel. The resulting unzippered connection will no longer contain contaminants or other fluids thereby compromising the barrier.

Previous methods of detecting and analyzing the integrity of a connection between adjacent panels have not been satisfactory. In particular, Applicant is aware of U.S. Pat. No. 5,497,097 to Walling et al. The system of Walling et al. utilizes electrical contacts on interlocking panels to detect connection between the two panels. However, the apparatus of Walling et al. may be prone to not detecting proper connection between adjacent panels should some other material interposed between the electrical connectors. Additionally, the apparatus of Walling et al. may falsely indicate proper connection between adjacent panels in the presence of salt water or other electrolytic fluids due to the electrical fluid conducing electricity between the two electrical panels.

SUMMARY OF THE DISCLOSURE

According to a first embodiment of the present disclosure there is disclosed a system for monitoring continuity between adjacent barrier members. Each barrier member has a first edge defining a first connector and an opposed second edge defining a second connector. The second connector is adapted to cooperatingly engage a corresponding first connector of an adjacent barrier member. The system comprises at least one detectable body locatable along the first connector of said barrier member and a detector locatable along the second connector of the adjacent barrier member. The detector is adapted to transmit a proximity signal in response to detecting proximity to the detectable bodies.

The system in one form may further comprise an indicator adapted to receive the proximity signal from the detector wherein the indicator is further adapted to provide indicate the receipt of the proximity signal to a user. The indicator and detector may have a conductor therebetween for transmitting the proximity signal from the detector to the indicator.

The detectable bodies may comprise a plurality of detectable bodies distributable along the first connector. The detectable bodies may comprise magnets wherein the detector may comprise a magnetic proximity switch. The system may further comprise a longitudinal seal locatable within the second connector wherein the longitudinal seal includes the detector.

According to a further embodiment there is disclosed an apparatus for forming a barrier wall. The apparatus comprises a barrier member having a first edge defining a first connector and an opposed second edge defining a second connector. The second connector is adapted to engage a corresponding first connector of an adjacent barrier member. The apparatus further comprises at least one detectable body locatable along the first connector of the barrier member and a detector located along the second connector. The detector is adapted to transmit a proximity signal in response to detecting proximity to the detectable body.

The apparatus may further comprise an indicator adapted to receive the proximity signal from the detector wherein the indicator is further adapted to provide indicate the receipt of the proximity signal to a user. The indicator and detector may have a conductor therebetween for transmitting the proximity signal from the detector to the indicator.

The detectable bodies may comprise a plurality of detectable bodies distributed along the first connector. The detectable bodies may comprise magnets wherein the detector may comprise a magnetic proximity switch. The detectable bodies may be embedded in the first connector.

The first and second connectors may be slidably engageable with each other. The first connector may comprise a male connector wherein the second connector may comprise a female connector. The male connector may comprise an elongated flange extending along the first edge wherein the female connector may define a c-shaped opening corresponding to the size and shape of the male connector. The apparatus may further comprise a longitudinal seal locatable within the c-shaped opening wherein the longitudinal seal includes the detector.

The second connector may have a longitudinal passage parallel to the second edge of the barrier member wherein the detector is adapted to be located within the longitudinal passage. The longitudinal passage may comprise a longitudinal bore. The detector may be slidably locatable within the longitudinal passage. The detector may be securable to the second connector with an adhesive.

According to a further embodiment there is disclosed a method for forming a barrier wall. The method comprises inserting a first barrier member into a soil formation. The first barrier member has a first edge defining a first connector having at least one detectable body. The method further comprises slidably engaging a second connector of a second barrier member with the first connector and inserting the second barrier member into the soil formation adjacent to the first barrier member while utilizing a detector associated with the second connector to detect proximity of the at least one detectable body to verify engagement of the first and second connectors.

According to a further embodiment there is disclosed a method for verifying a connection between adjacent barrier members. Each barrier member has a first edge defining a first connector and an opposed second edge defining a second connector. The second connector is adapted to engage a corresponding first connector of an adjacent barrier member. The method comprises providing at least one detectable body along the first connector, slidably moving a detector adapted to detect proximity of the detectable bodies within a longitudinal passage along the second connector of the adjacent barrier member and providing a proximity signal in response to the detector detecting proximity to the detectable bodies.

BRIEF DESCRIPTION OF THE DRAWINGS

In drawings which illustrate embodiments wherein similar characters of reference denote corresponding parts in each view.

DETAILED DESCRIPTION

Figure 1:
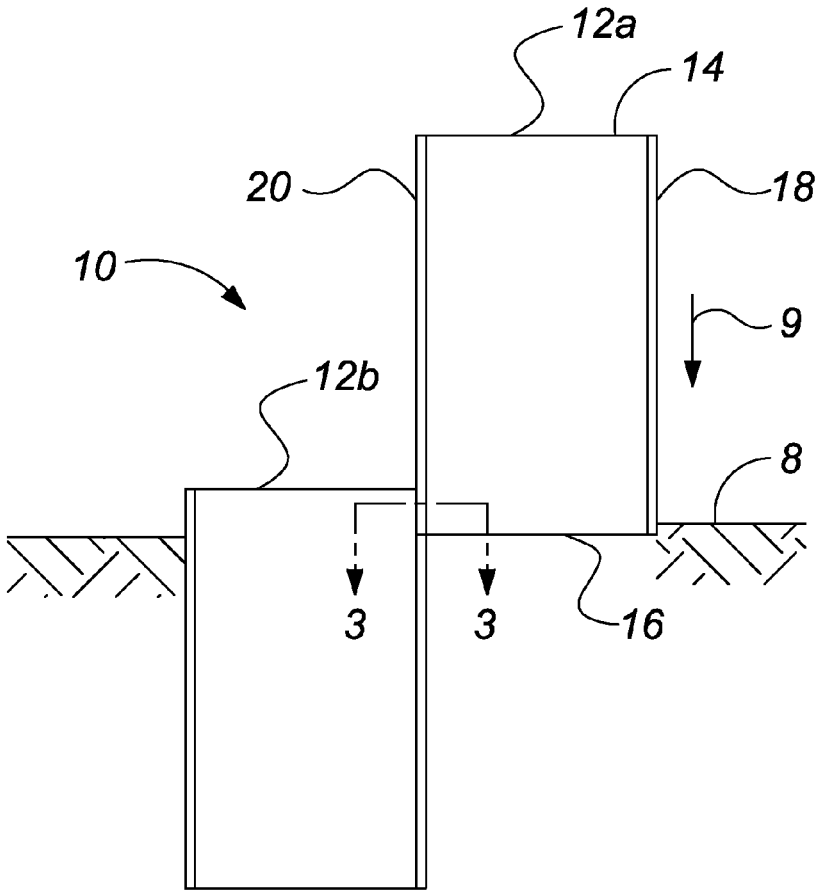
FIG. 1 is a front elevation view of a barrier wall being formed in a soil formation utilizing interlocking barrier members according to a first embodiment.

Referring to FIG. 1, a barrier wall is shown generally at 10 being formed in a soil formation 8. The barrier wall 10 comprises a plurality of barrier members 12 inserted into the soil formation 8 adjacent to and interlocked with each other so as to form a continuous barrier wall 10. The barrier wall 10 may, by way of non-limiting example be a sheet piling wall wherein the barrier members comprise impermeable sheets. Barrier members 12, such as barrier piling sheets, for use in forming barrier walls in soil formation 8 are known in the art. Methods of inserting such barrier member are also known in the art, such as, by way of non-limiting example, by utilizing known pile driver methods such as drop hammers, vibratory hammers or plate tampers and excavators, utilizing a mandrel or digging a trench to receive the barrier members 12. As illustrated in FIG. 1, the barrier wall 10 may be formed by inserting a first barrier member 12*a* into the soil formation and thereafter inserting a second barrier member 12*b* adjacent to and slidably interlocked with the first barrier member 12*a*.

Figure 2:
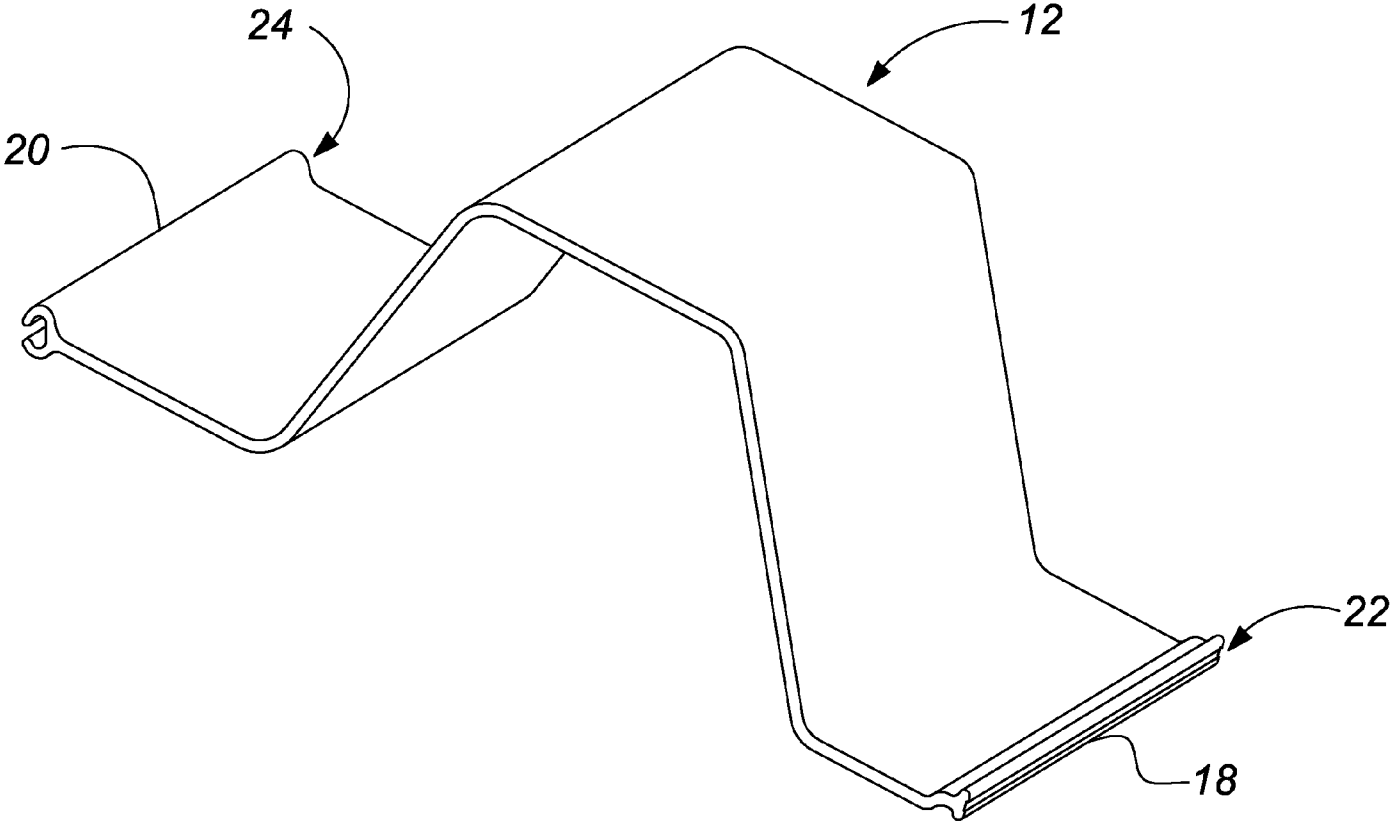
FIG. 2 is a perspective view of a section of the barrier member of FIG. 1.

With reference to the first barrier member 12*a*, in one form each barrier member comprises a body having a substantially rectangular outline defined by top 14, bottom 16 and first and second side edges, 18 and 20, respectively. As illustrated in FIG. 2, the barrier member 12 may comprise a sheet of material having a variety of cross section profiles as are commonly known in the art. For example, by way of non-limited example, the barrier member 12 may have a substantially planar, z-shaped, a double z-shape, u-shaped or c-shaped cross section profile. As illustrated in FIG. 1, the top and bottom edges 14 and 16 are substantially parallel to each other. Furthermore, the first and second side edges 18 and 20 are substantially parallel to each other and substantially perpendicular to the top and bottom edges. The first edge 18 has a first connector 22 disposed therealong while the second edge 20 has a second connector 24 disposed therealong. As further described below, the first and second connectors 22 and 24, are adapted to cooperate with corresponding first and second connectors of adjacent panels. The barrier members 12 may be formed of any known material in the art. Barrier members may be formed of metal, such as steel or aluminium, resins such as vinyl, polyvinyl chloride (PVC) or other known plastics, or composite materials such as fibreglass or carbon fibre by way of non-limiting example.

Figure 3:
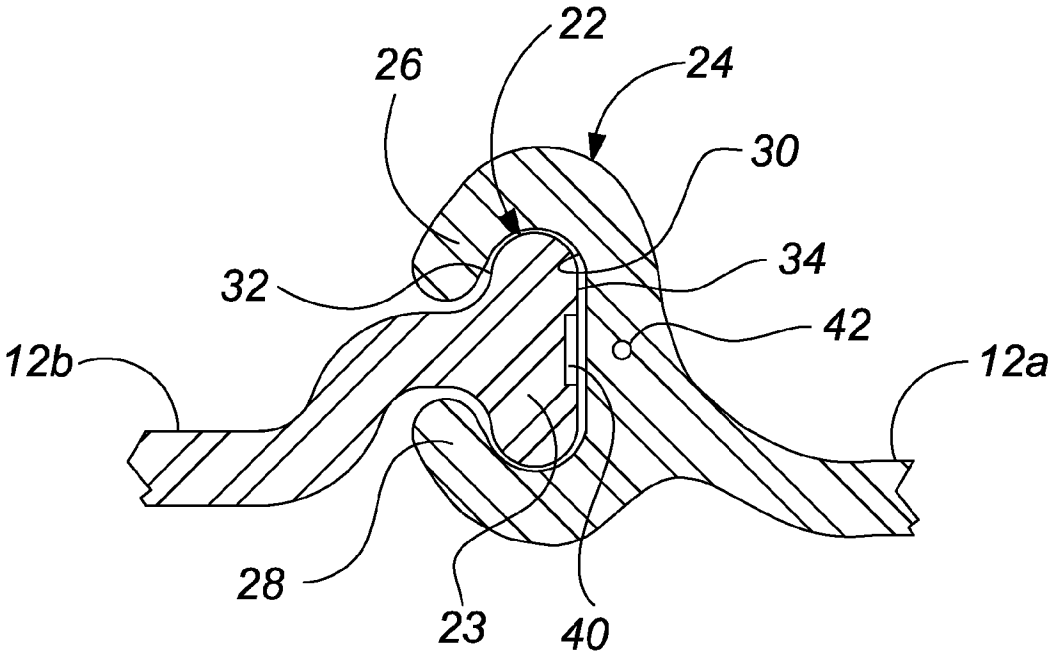
FIG. 3 is a cross-sectional view of the connection between the adjacent barrier members of FIG. 1 taken along the line 3-3.

Turning now to FIG. 3, a cross-sectional view of a connection between adjacent first and second barrier members 12*a* and 12*b* in one form is illustrated. As illustrated, the first connector 22 of the second barrier member 12*b* is interlocked with the second connector 24 of the first barrier member 12*a*. In the embodiment illustrated in FIG. 3, the first connector 22 comprises an elongate flange 23 extending along the length of the first edge 18 of the barrier member. The flange 23 of the first connector 22 has front and rear surfaces, 34 and 32, respectively. The second connector 24 comprises a c-shaped channel 30 extending along the second edge 20. The c-shaped channel 30 is defined by first and second opposed partitions, 26 and 28, respectively adapted to surround the flange 23 and bear against the rear surface 32 of the first connector so as to retain the flange within the c-shaped channel 30.

As illustrated in FIG. 2, the first and second connectors 22 and 24 extend along the first and second edges 18 and 20 of the barrier member. It will therefore be appreciated that the first connector 22 in one form is adapted to be longitudinally slidable within the second connector 24. Adjacent first and second barrier members 12*a* and 12*b* may be connected by first interlocking the second connector 24 of the first barrier member with the first connector 22 of the second barrier member. The first barrier member 12*a* may then be moved in a direction generally indicated at 9 in FIG. 1 parallel to the second barrier member until the first and second barrier members 12*a* and 12*b* form a continuous barrier wall 10. Successive barrier members 12 may then be added to lengthen the barrier wall 10.

The first connector 22 in one form includes at least one detectable body 40. As illustrated in FIG. 3, the detectable bodies 40 are embedded in the front face 34 of the flange. It will be appreciated that the detectable bodies 40 may also be embedded within the flange 23 below the surface thereof or secured to the surface of the flange. The second connector 24 includes a longitudinal bore 42 therein. The longitudinal bore 42 is sized to receive a detector 70 (shown in FIG. 6). The detector 70 is adapted to detect the proximity of the detectable bodies 40 in the first connector 22.

Figure 4:
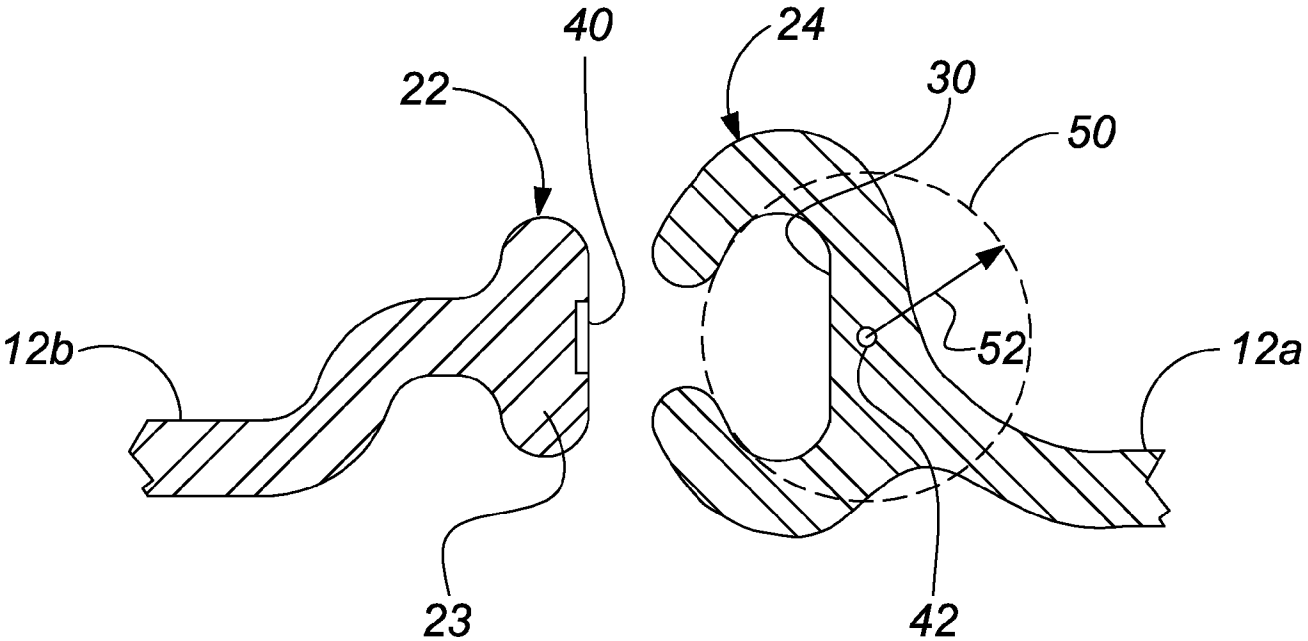
FIG. 4 is a cross-sectional view of the barrier members of FIG. 3 decoupled from each other.

Turning now to FIG. 4, the first and second connectors 22 and 24 are illustrated in a de-interlocked arrangement. As illustrated, the detector 70 located within longitudinal bore 42 has an effective range indicated generally at 50 having a radius 52. The range 50 of the detector 70 is selected such that only detectable bodies 40 located within the c-shaped channel 30 will be detected while detectable bodies 40 outside of the c-shaped channel will not be detected. Accordingly, it will be appreciated that the detector 70 may be utilized to detect when the first connector 22 is correctly interlocked with the second connector 24. For other embodiments illustrated and described below, similar ranges 50 for the detector 70 should be selected to ensure that the detectable bodies 40 are only detected when the first and second connector are properly interlocked.

The detectable bodies 40 may comprise any known body that is readily detectable based upon proximity by a corresponding detector 70. The detectable bodies 40 may be formed of magnets, metallic bodies, active or passive Radio Frequency Identification (RFID) tags, magnetic metals or a radioactive material by way of non-limiting example. It will be appreciated that many other detectable materials may also be utilized. Applicant has found that magnets are particularly useful as the detectable bodies 40. In such embodiments, the detector 70 may be a magnetic proximity switch having a reed switch located within the longitudinal bore 42. It will also be appreciated that a reed sensor, reed relay or any other known magnets field switch device may be utilized as well. For embodiments utilizing RFID, magnetic metals, or radioactive materials, the corresponding detectors may be an RFID antenna, a metal detector or a particle detector such as a Geiger counter.

Figure 5:
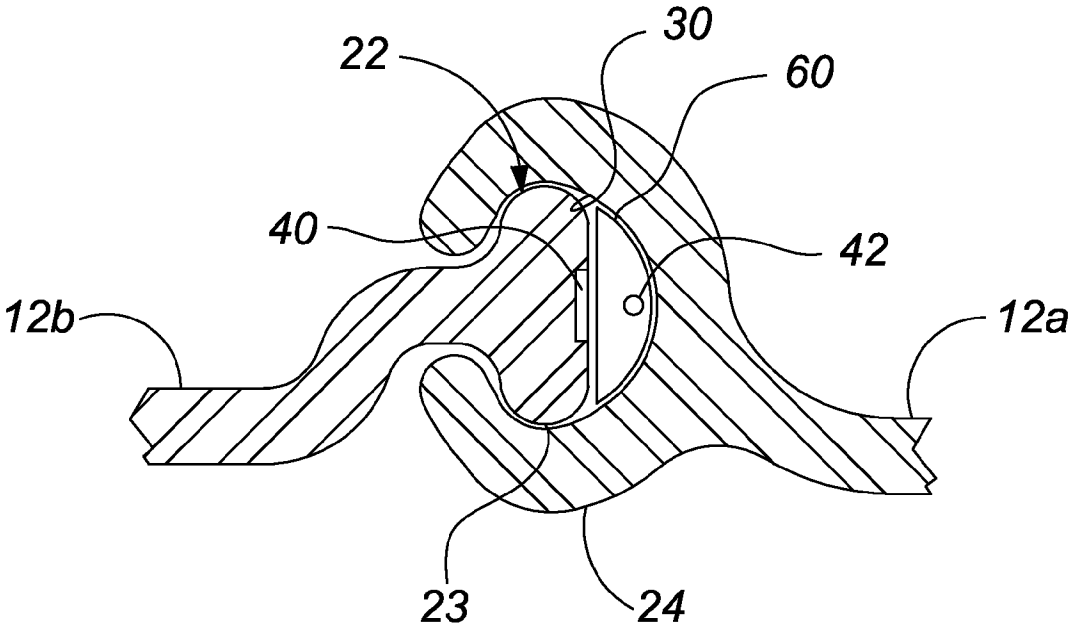
FIG. 5 is a cross-sectional view of the connection between the adjacent barrier members of FIG. 1 taken along the line 3-3 according to an alternative embodiment.

As illustrated in FIG. 5, according to an alternative embodiment of the present invention, the c-shaped channel 30 may optionally include a longitudinal seal 60 located therein. In this embodiment, the c-shaped channel 30 may be modified or enlarged so as to accommodate the longitudinal seal. The longitudinal seal 60 may include the longitudinal bore 42 therein. It will be appreciated that the longitudinal seal 60 may permit the retrofitting of the present invention to existing barrier members 12. In operation, the c-shaped channel 30 of an existing barrier member 12 may be enlarged by known methods, such as, by way of non-limiting example, machining, grinding or plastic deformation to a size sufficient to accept both the first connector 22 and the longitudinal seal 60. It will also be appreciated that the first connector 22 may also be correspondingly reduced in size by similar methods to permit both the first connector 22 and the longitudinal seal 60 to be located within the c-shaped channel 30. It will be appreciated that the longitudinal seal 60 may also have the detector 70 cast integrally with it or have it otherwise formed with the detector. By way of non-limiting example, the longitudinal seal may also be formed by applying a volume of a caulking, grout, or cured rubber to the c-shaped channel 30 before the barrier members 12 are connected together. The detector 70 may be covered by any of these materials to form a seal in the c-shaped channel 30. It will also be appreciated that the detector may be secured to any surface of the second connector 24 so as to enable it to properly detect the proximity of the detectable bodies 40. For example, the detector may be secured to the exterior surface of the second connector 24 at a location where the second connector joins with the barrier member 12*a* as generally indicated at 54 in FIG. 5.

The longitudinal seal 60 may assist in the sealing of the connection between the first and second connectors 22 and 24. It has been found that hydrophilic seals may be particularly useful although any other type of known seal may be utilized as well. The seal 60 may also be hydrophobic or may be optionally formed of grout, cured rubber or any other type of applied material. In such embodiments, the applied material may be placed within the c-shaped channel 30 prior to connecting with the adjacent barrier member.

Figure 6:
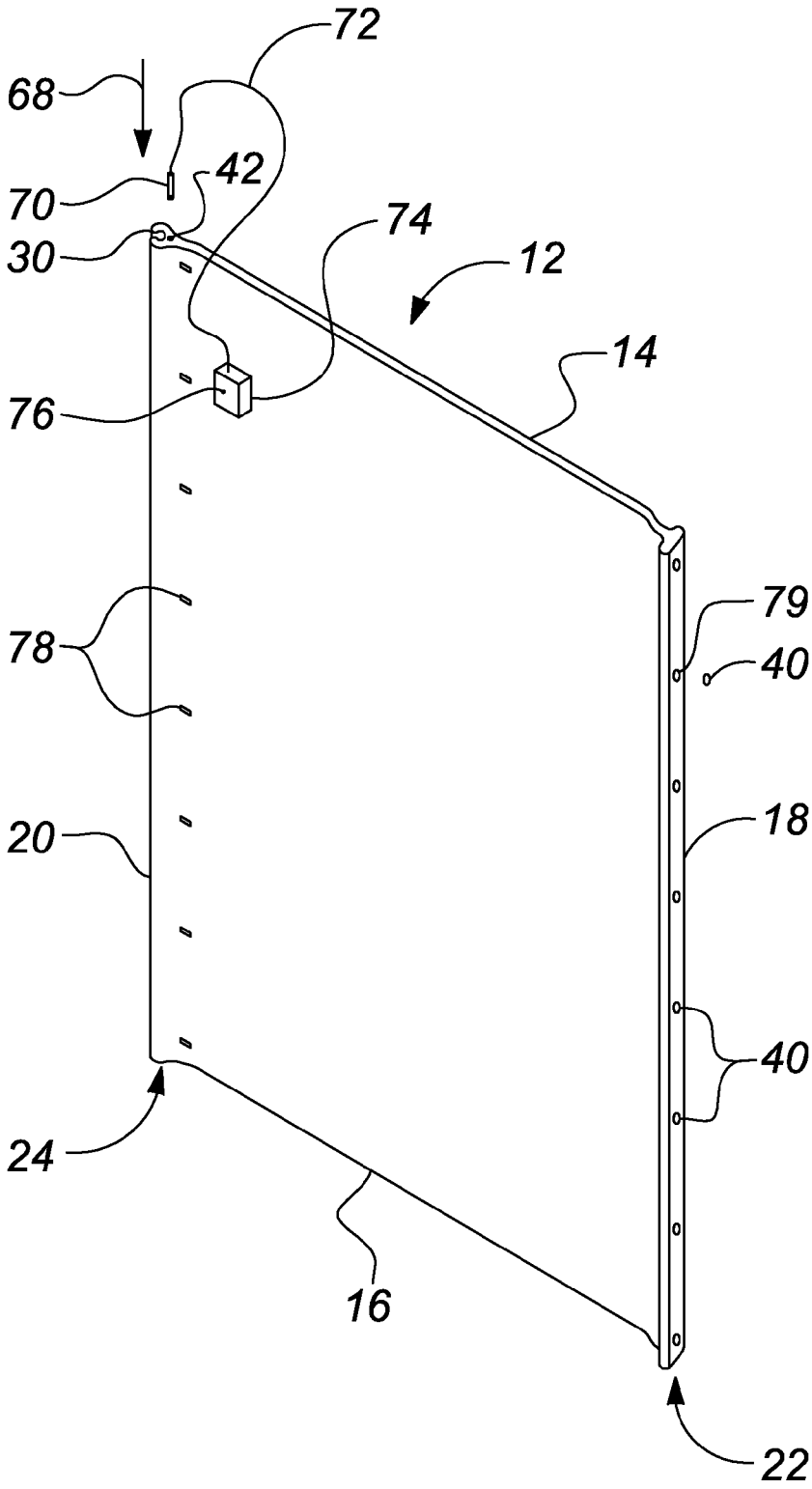
FIG. 6 is a perspective view of a barrier member of FIG. 1 showing a plurality of spaced out detectable bodies.

Turning now to FIG. 6, a perspective view of a barrier member 12 is illustrated having a plurality of detectable bodies 40 applied to the first connector 22. The plurality of detectable bodies 40 may be arranged along the first connector in a regular array at predetermined intervals. The system according to one embodiment of the present invention may therefore be utilized to determine if the entire length of the connection between the first and second connectors is properly interlocked. The detectable bodies 40 may be secured to the surface of the first connector 22. Optionally, the detectable bodies 40 maybe embedded within the first connector 22. In some embodiments, a user may drill or otherwise remove material from the first connector 22 so as to form a cavity 79 therein. The user may then locate and secure the detectable bodies 40 within the cavities 79. It will also be appreciated that the detectable bodies 40 may be cast internally or at the surface of the barrier member 12 during formation of the barrier member. The barrier member 12 may also be cast or otherwise formed with cavities included in a size sufficient to receive the detectable bodies 40. It will be appreciated that for embodiments in which only one detectable body 40 is utilized, the location of the detectable body 40 should be selected to be substantially adjacent to the bottom 16 of the barrier member 12.

The barrier member 12 may also include an indicator 74 secured thereto in communication with the detector 70. The indicator 74 may be in communication with the detector 70 through a communication conductor 72. It will be appreciated that other methods of communication between the detector 70 and indicator 74 may also be useful as well such as radio frequency or infrared. The indicator 74 may be secured to the barrier member 12 as illustrated or may be mounted to an adjacent structure or held by a user. As illustrated, the detector 70 may be inserted into the longitudinal bore 42 in the direction generally indicated at 68. It will be appreciated that many known methods of inserting the detector 70 may be utilized including a push rod, or by utilizing a wirepuller. In some embodiments, it will be appreciated that the detector 70 may be moveable both in direction 68 and a reverse direction so as to enable a user to selectively check the interconnection of the first and second connectors corresponding to each of the plurality of detectable bodies 40.

The indicator 74 indicates to a user that the detector 70 has detected the proximity of a detectable body. The indicating means may include, by way of non-limiting example, a light, a noisemaker such as a siren or a horn. As illustrated in FIG. 6, the indicating means is a light 76 although any other known method of indicating may also be used. In some embodiments, the indicator may communicate a signal to be received by a corresponding receiver so as to permit the collection of data in a computer or the like. As illustrated in FIG. 6, the barrier member may also include indication marks 78 corresponding to the known locations of the detectable bodies on a corresponding barrier member. The indication marks 78 may be utilized to indicate to a user when a detectable body 40 is expected to be detected during installation of one barrier member 12 with another. In operation, the user may locate the detector 70 at a known depth within the longitudinal bore 42. The indication marks 78 may therefore correspond to the current depth of the barrier member 12 being inserted when a detectable body is expected to be detected by the detector 70. In such embodiments it will be appreciated that the detectable bodies 40 would be beneficially arranged at regular intervals.

Figure 7:
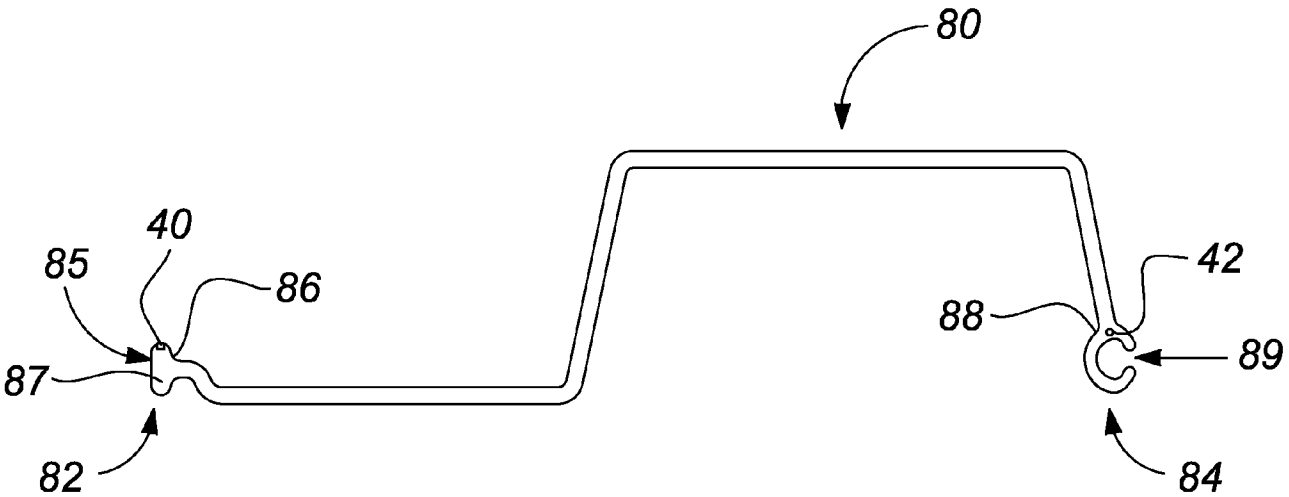
FIG. 7 is a cross-sectional view of the connection between the adjacent barrier members of FIG. 1 taken along the line 3-3 according to an alternative embodiment.

Turning now to FIG. 7, a cross-sectional view of an alternative embodiment of a barrier member is shown generally at

80. As illustrated, the barrier member 80 may have first and second side edges, 82 and 84, respectively having corresponding first and second connectors 86 and 88, respectively. The first and second connectors 86 and 88 are adapted to interconnect with first and second connectors of adjacent barrier members to form a continuous barrier wall. As illustrated the first connector 86 may comprise a flange 87 as described above with reference to FIGS. 2 through 6. The second connector 88 may comprise a c-shaped channel 89 similar to the c-shaped channel shown in FIGS. 2 through 6. As illustrated, the c-shaped channel 89 may be eccentrically connected to the barrier member 80. In the present embodiment, the detectable bodies may be located to one side of the flange 87 of the first connector 86 while the detector 70 is located to the corresponding side of the c-shaped channel 89 of the second connector 88. The barrier member may also include a longitudinal seal 60 within the c-shaped channel 89. It will be appreciated that for embodiments having a longitudinal seal 60, that the detectable bodies may be located in an end surface 85 of the flange 87.

Figure 8:
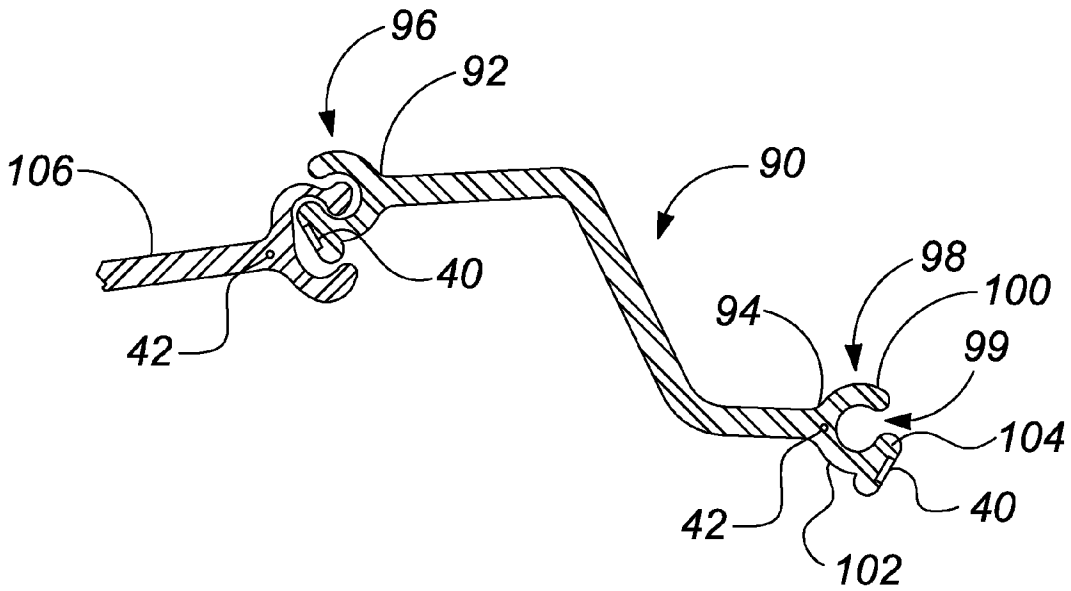
FIG. 8 is a cross-sectional view of the connection between the adjacent barrier members of FIG. 1 taken along the line 3-3 according to an alternative embodiment.

Turning now to FIG. 8, a cross-sectional view of a further alternative embodiment of the barrier member is shown generally at 90. As illustrated, the barrier member 90 may have first and second side edges, 92 and 94, respectively having corresponding first and second connectors 96 and 98, respectively. The first and second connectors 96 and 98 may have substantially similar profiles. As illustrated the first and second connectors 96 and 98 may be mirror images of each other. With reference to the second connector 98, each connector may comprise a c-shaped channel 99 formed by first and second portions, 100 and 102 respectively. As illustrated, the second portion 102 may have a flange 104 at a distal end thereof. The flange 104 is adapted to be received within the c-shaped channel 99 of an adjacent barrier member 106. It will be appreciated that the adjacent barrier member 106 may be inverted about a horizontal axis such that the flange 104 of each barrier member is received within the c-shaped channel 99 of the other barrier member. In the present embodiment, the detectable bodies may be located in the flange 104 while the detector 70 is located to at a portion of the c-shaped channel 99 adapted to correspond to the detectable bodies 40. Alternatively, each barrier member may include a detector 70 and detectable bodies 40 such that each barrier member 90 detects the detectable bodies of the adjacent barrier member. Accordingly, such a system may have a redundant system for checking continuity of the barrier wall. The barrier member may optionally have longitudinal seals or have the detector 70 and detectable bodies located to one side of the flanges 104 and c-shaped channels 99 as discussed above.

Figure 9:
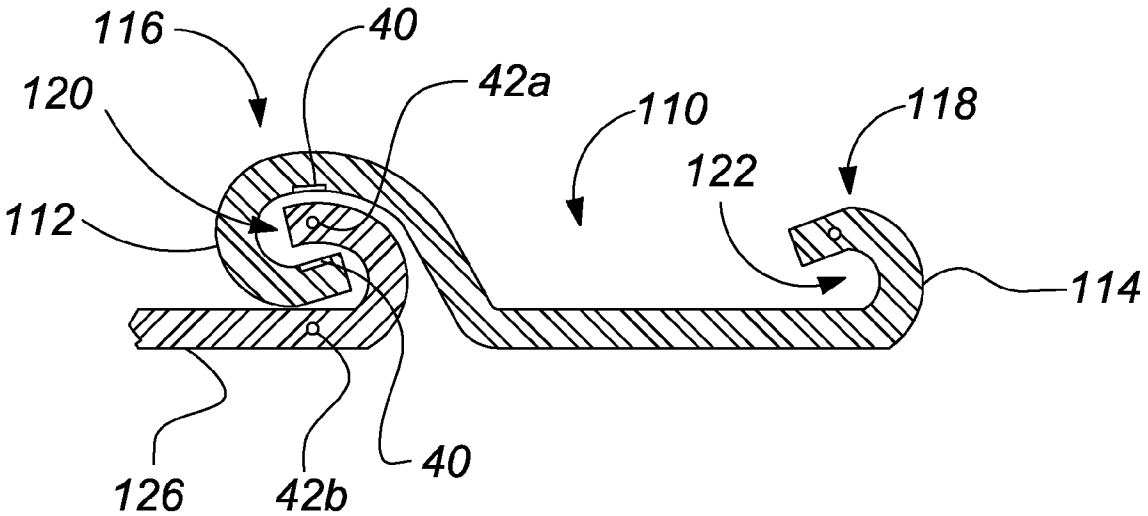
FIG. 9 is a cross-sectional view of the connection between the adjacent barrier members of FIG. 1 taken along the line 3-3 according to an alternative embodiment of the present invention.

Turning now to FIG. 9, a cross-sectional view of an alternative embodiment of the barrier member is shown generally at 110. As illustrated, the barrier member 110 may have first and second side edges, 112 and 114, respectively having corresponding first and second connectors 116 and 118, respectively. The first and second connectors 116 and 118 are adapted to interconnect with first and second connectors of adjacent barrier members to form a continuous barrier wall. As illustrated, the first connector 116 may comprise large c-shaped channel 120 continuously formed with the barrier member 110. The second connector 118 may comprise a small c-shaped channel 122 continuously formed with the barrier member 110. As illustrated the small c-shaped channel 122 may connected at an opposite side to the side of the large c-shaped channel 120 that is connected to the barrier member 110. The small c-shaped channel 122 is adapted to be interlockably received within the large c-shaped channel 120 as illustrated. In the present embodiment, the detectable bodies may be located at any location around the c-shaped channel 120, to be detectable by detectors at one or more of a plurality of locations such as by way of non-limiting example, a distal detector 42*b* proximate to a distal end 124 of the c-shaped channel or as an internal detector 42*b* at a transition 126 of the c-shaped channel to the barrier member 110. The barrier member may optionally have longitudinal seals as discussed above located within the interconnection therebetween.

Figure 10:
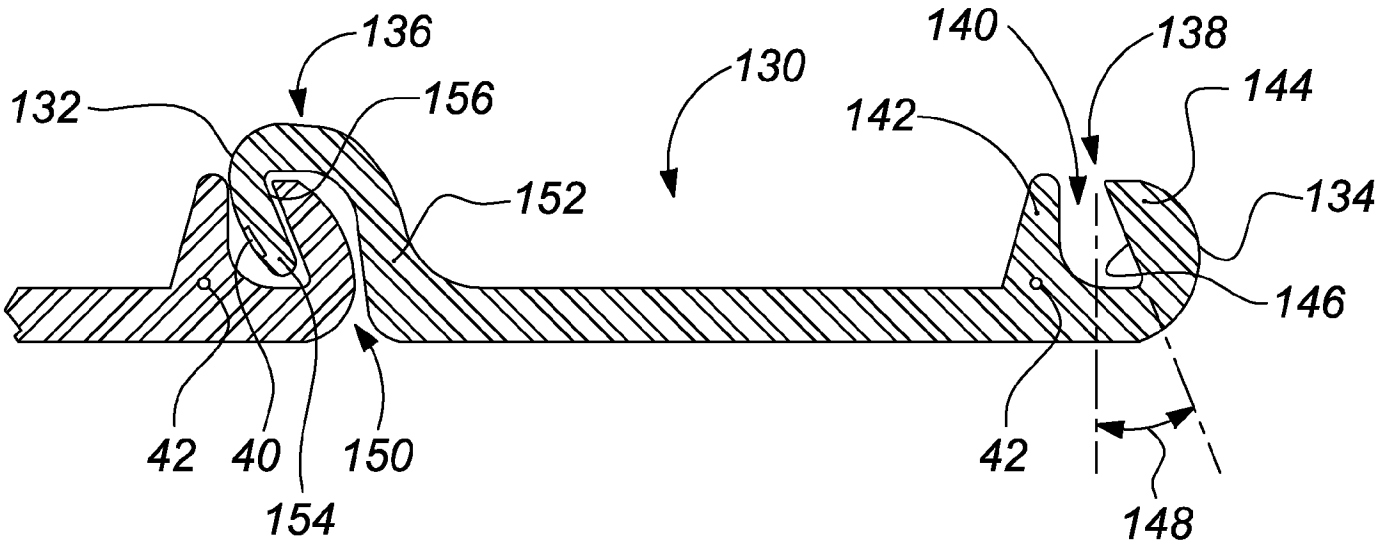
FIG. 10 is a cross-sectional view of the connection between the adjacent barrier members of FIG. 1 taken along the line 3-3 according to an alternative embodiment.

Turning now to FIG. 10, a cross-sectional view of an alternative embodiment of the barrier member is shown generally at 130. As illustrated, the barrier member 130 may have first and second side edges, 132 and 134, respectively having corresponding first and second connectors 136 and 138, respectively. The first and second connectors 136 and 138 are adapted to interconnect with first and second connectors of adjacent barrier members to form a continuous barrier wall.

As illustrated, the first connector 138 may comprise u-shaped channel 140 formed between a first upright 142 and a second upright 144. The second upright 144 forms a first engagement surface 146 oriented at an angle generally indicated at 148 from perpendicular to the barrier member 130. The second connector 136 comprises an inverted u-shaped channel 150 having a proximate end 152 continuous with the barrier member 130 and a free distal end 154. The inverted u-shaped channel 150 includes a second engagement surface 156 having an angle corresponding to the angle 148 of the first engagement surface. The free distal end 154 of the first connector 136 is adapted to be received within the u-shaped channel 140 such that the first engagement surface 146 bears against the second engagement surface 156. In the present embodiment, the detectable bodies 40 and detectors 70 may be located at any locations within the inverted u-shaped channels 150 and the u-shaped channel 140 such that they will be proximate to each other when adjacent panels are interconnected. The barrier member may optionally have longitudinal seals as discussed above located within the interconnection therebetween.

While specific embodiments of the invention have been described and illustrated, such embodiments should be considered illustrative of the invention only and not as limiting the invention as construed in accordance with the accompanying claims.

What is claimed is:

1. A system for monitoring continuity between adjacent barrier members, each barrier member having a first edge defining a first connector and an opposed second edge defining a second connector, said second connector being adapted to cooperatingly engage a corresponding first connector of an adjacent barrier member, the system comprising:

a) at least one detectable body locatable along said first connector of said barrier member; and b) a detector locatable along contained within a longitudinal passage along said second connector of said adjacent barrier member, wherein said detector is adapted to transmit a proximity signal in response to detecting proximity to said at least one detectable body.

2. The system of claim 1 further comprising an indicator adapted to receive said proximity signal from said detector wherein said indicator is further adapted to provide indicate said receipt of said proximity signal to a user.

3. The system of claim 2 wherein said indicator and said detector have a conductor therebetween for transmitting said proximity signal from said detector to said indicator.

4. The system of claim 1 wherein said at least one detectable body comprises a plurality of detectable bodies distributable along said first connector.

5. The system of claim 1 wherein said at least one detectable body comprise magnets wherein said detector comprises a magnetic proximity switch.

6. The system of claim 1 further comprising a longitudinal seal locatable within said second connector wherein said longitudinal seal includes said detector.

7. An apparatus for forming a barrier wall, the apparatus comprising:

a) a barrier member having a first edge defining a first connector and an opposed second edge defining a second connector, said second connector being adapted to engage a corresponding first connector of an adjacent barrier member; said second connector having a longitudinal passage parallel to said second edge of said barrier member;

b) at least one detectable body locatable along said first connector of said barrier member; and c) a detector contained within said longitudinal passage of said second connector, wherein said detector is adapted to transmit a proximity signal in response to detecting proximity to said at least one detectable body.

8. The apparatus of claim 7 further comprising an indicator adapted to receive said proximity signal from said detector, wherein said indicator is further adapted to provide indicate said receipt of said proximity signal to a user.

9. The apparatus of claim 8 wherein said indicator and said detector have a conductor therebetween for transmitting said proximity signal from said detector to said indicator.

10. The apparatus of claim 7 wherein said at least one detectable body comprises a plurality of detectable bodies distributed along said first connector.

11. The apparatus of claim 7 wherein said at least one detectable body comprise magnets wherein said detector comprises a magnetic proximity switch.

12. The apparatus of claim 7 wherein said at least one detectable body is embedded in said first connector.

13. The apparatus of claim 7 wherein the first and second connectors are slidably engageable with each other.

14. The apparatus of claim 13 wherein said first connector comprises a male connector wherein said second connector comprises a female connector.

15. The apparatus of claim 14 wherein said male connector comprises an elongated flange extending along said first edge wherein said female connector defines a c-shaped opening corresponding to the size and shape of said male connector.

16. The apparatus of claim 15 further comprising a longitudinal seal locatable within said c-shaped opening wherein said longitudinal seal includes said detector.

17. The apparatus of claim 7 wherein said second connector has a longitudinal passage parallel to said second edge of said barrier member wherein said detector is adapted to be located within said longitudinal passage.

18. The apparatus of claim 7 wherein said longitudinal passage comprises a longitudinal bore.

19. The apparatus of claim 7 wherein said detector is slidably locatable within said longitudinal passage.

20. The apparatus of claim 7 wherein said detector is securable to said second connector with an adhesive.

21. A method for forming a barrier wall, the method comprising:

a) inserting a first barrier member into a soil formation, said first barrier member having a first edge defining a first connector having at least one detectable body;

b) slidably engaging a second connector of a second barrier member with said first connector; and c) inserting said second barrier member into said soil formation adjacent to said first barrier member while utilizing a detector contained within a longitudinal passage along said second connector to detect proximity of said at least one detectable body to verify engagement of said first and second connectors.

22. A method for verifying a connection between adjacent barrier members, each barrier member having a first edge defining a first connector and an opposed second edge defining a second connector, said second connector being adapted to engage a corresponding first connector of an adjacent barrier member, the method comprising:

a) providing at least one detectable body along said first connector;

b) slidably moving a detector adapted to detect proximity of said at least one detectable body contained within a longitudinal passage along said second connector of said adjacent barrier member; and c) providing a proximity signal in response to said detector detecting proximity to said at least one detectable body.

* * * * *